US010909896B2

(12) United States Patent
Zhan et al.

(10) Patent No.: US 10,909,896 B2
(45) Date of Patent: Feb. 2, 2021

(54) COMMON VOLTAGE GENERATION CIRCUIT AND GENERATION METHOD, AND DISPLAY DEVICE

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Yifei Zhan, Beijing (CN); Dayu Zhang, Beijing (CN); Xiaohan Ling, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/485,044

(22) PCT Filed: Dec. 21, 2018

(86) PCT No.: PCT/CN2018/122547

§ 371 (c)(1),
(2) Date: Aug. 9, 2019

(87) PCT Pub. No.: WO2019/137179

PCT Pub. Date: Jul. 18, 2019

(65) Prior Publication Data

US 2020/0013324 A1 Jan. 9, 2020

(30) Foreign Application Priority Data

Jan. 9, 2018 (CN) ..... 2018 1 0019046

(51) Int. Cl.
*G09G 5/00* (2006.01)
*G09G 3/20* (2006.01)

(52) U.S. Cl.
CPC ..... *G09G 3/20* (2013.01); *G09G 2300/0828* (2013.01); *G09G 2300/0833* (2013.01);
(Continued)

(58) Field of Classification Search
CPC ..... G09G 3/20; G09G 2300/0828; G09G 2300/0833; G09G 2310/0291;
(Continued)

(56) References Cited

U.S. PATENT DOCUMENTS 7,710,414 B2 5/2010 Lee et al.
9,715,856 B2 7/2017 Wang et al.
(Continued)

FOREIGN PATENT DOCUMENTS

CN 1499478 A 5/2004
CN 103680455 A 3/2014
(Continued)

OTHER PUBLICATIONS

First Office Action dated Jan. 21, 2020 for corresponding Chinese application 201810019046.6.

*Primary Examiner* — Adam R. Giesy
(74) *Attorney, Agent, or Firm* — Nath, Goldberg & Meyer; Joshua B. Goldberg

(57) ABSTRACT

The present disclosure provides a common voltage generation circuit, a common voltage generation method, and a display device, and belongs to the field of display technology. The common voltage generation circuit includes: an initial common voltage generation component configured to generate an initial common voltage controlled by a ground voltage and a positive power supply voltage according to a clock synchronization signal and a serial digital signal as received; and a common voltage adjustment component configured to generate a common voltage controlled by the
(Continued)

ground voltage and a negative power supply voltage according to the initial common voltage.

15 Claims, 2 Drawing Sheets

(52) U.S. Cl.
CPC ..... *G09G 2310/0291* (2013.01); *G09G 2330/021* (2013.01); *G09G 2330/025* (2013.01)

(58) Field of Classification Search
CPC ..... G09G 2330/021; G09G 2330/025; G09G 3/3614; G09G 2300/0823; G09G 2310/0254; G09G 2330/026; G09G 2310/066; G09G 2330/02; G09G 3/3655; G09G 3/3208; G09G 3/3696
See application file for complete search history.

(56) References Cited

U.S. PATENT DOCUMENTS

| | | | | |
|---|---|---|---|---|
| 2005/0140400 | A1 | 6/2005 | Yi et al. | |
| 2010/0097361 | A1* | 4/2010 | Oku | G09G 3/3655 345/209 |
| 2011/0164014 | A1* | 7/2011 | Todorovich | G09G 3/3466 345/208 |
| 2020/0013324 | A1 | 1/2020 | Zhan et al. | |

FOREIGN PATENT DOCUMENTS

| | | | |
|---|---|---|---|
| CN | 105489187 | A | 4/2016 |
| CN | 105513527 | A | 4/2016 |
| CN | 106328035 | A | 1/2017 |
| CN | 107342063 | A | 11/2017 |
| CN | 107437407 | A | 12/2017 |
| CN | 107464535 | A | 12/2017 |
| CN | 108198531 | A | 6/2018 |
| KR | 20050023080 | A | 3/2005 |

* cited by examiner

COMMON VOLTAGE GENERATION CIRCUIT AND GENERATION METHOD, AND DISPLAY DEVICE

CROSS-REFERENCE TO RELATED APPLICATION

This is a National Phase Application filed under 35 U.S.C. 371 as a national stage of PCT/CN2018/122547, filed on Dec. 21, 2018, an application claiming priority to Chinese Patent Application No. 201810019046.6 filed to State Intellectual Property Office of the Republic of China on Jan. 9, 2018, the disclosure of which is hereby incorporated by reference in its entirety.

TECHNICAL FIELD

The present disclosure relates to the field of display technology, in particular, to a common voltage generation circuit, a common voltage generation method, and a display device.

BACKGROUND

Currently, the common voltage (VCOM) of a display panel is usually generated by a power management integrated circuit (PMIC). After powered on, the PMIC first generates a positive power supply voltage VSP and a negative power supply voltage VSN. Thereafter, an operational amplifier generates a stable VCOM and outputs the same after the positive power supply voltage VSP and the negative power supply voltage VSN are stabilized. After the VCOM is outputted, an amplitude of the VCOM is adjusted through the I2C bus. This adjustment manner is simple and the accuracy of adjustment is 0.01V.

However, due to the characteristics of the operational amplifier itself, when the positive supply voltage VSP and the negative supply voltage VSN are not completely stabilized, the output will follow the power supply voltage which arrives at the steady state first, resulting in that glitches or spikes following the VSP or the VSN occur to the VCOM during the power-on stage. In fact, it is difficult to cause the positive power supply voltage VSP and the negative power supply voltage VSN to be stable simultaneously so as to eliminate the effect of the glitches or spikes. As a result, the common voltage generated by the existing PMIC will cause poor display on the display panel.

SUMMARY

The present disclosure provides a common voltage generation circuit which includes: an initial common voltage generation component configured to generate an initial common voltage controlled by a ground voltage and a positive power supply voltage according to a clock synchronization signal and a serial digital signal as received; and a common voltage adjustment component configured to generate a common voltage controlled by the ground voltage and a negative power supply voltage according to the initial common voltage.

According to an embodiment of the present disclosure, the common voltage adjustment component includes a second operational amplifier, wherein, the second operational amplifier has a non-inverting input terminal provided with the ground voltage and an inverting input terminal coupled to an output terminal of the initial common voltage generation component, and is configured to generate the common voltage controlled by the ground voltage and the negative power supply voltage according to the initial common voltage and to output the common voltage by an output terminal of the second operational amplifier, and wherein the ground voltage and the negative power supply voltage are supply voltages applied to the second operational amplifier by a power management integrated circuit after powered on.

According to an embodiment of the present disclosure, the common voltage adjustment component further includes a first resistor and a second resistor, and wherein, the first resistor is coupled between the output terminal of the initial common voltage generation component and the inverting input terminal of the second operational amplifier; and the second resistor is coupled between the inverting input terminal and the output terminal of the second operational amplifier.

According to an embodiment of the present disclosure, a resistance of the second resistor is smaller than that of the first resistor.

According to an embodiment of the present disclosure, the initial common voltage generation component includes a master controller, a digital-to-analog converter, and a first operational amplifier, wherein, the master controller has an input terminal coupled to an I2C bus including a clock terminal and a data terminal and an output terminal coupled to an input terminal of the digital-to-analog converter; an output terminal of the digital-to-analog converter is coupled to a non-inverting input terminal of the first operational amplifier, and an inverting input terminal of the first operational amplifier is coupled to an output terminal of the first operational amplifier, the master controller is configured to receive the clock synchronization signal and the serial digital signal provided by a host through the clock terminal and the data terminal, modulate the serial digital signal using the clock synchronization signal, and output the modulated digital signal to the digital-to-analog converter so that the digital-to-analog converter outputs a first common voltage to the non-inverting input terminal of the first operational amplifier; the first operational amplifier generates the initial common voltage controlled by the ground voltage and the positive power supply voltage according to the first common voltage, wherein the ground voltage and the positive power supply voltage are supply voltages applied to the first operational amplifier by the power management integrated circuit after powered on.

The present disclosure further provides a common voltage generation method which includes:

generating an initial common voltage controlled by a ground voltage and a positive power supply voltage according to a clock synchronization signal and a serial digital signal as received; and generating a common voltage controlled by the ground voltage and a negative power supply voltage according to the initial common voltage.

According to an embodiment of the present disclosure, the step of generating the common voltage controlled by the ground voltage and the negative power supply voltage according to the initial common voltage includes:

generating, by a second operational amplifier according to the initial common voltage, the common voltage controlled by the ground voltage and the negative power supply voltage, and outputting the common voltage by an output terminal of the second operational amplifier, wherein the ground voltage and the negative power supply voltage are supply voltages applied to the second operational amplifier by a power management integrated circuit after powered on.

According to an embodiment of the present disclosure, the step of generating the initial common voltage controlled by the ground voltage and the positive power supply voltage according to the clock synchronization signal and the serial digital signal as received includes:

receiving, by a master controller, the clock synchronization signal and the serial digital signal provided by a host, modulating the serial digital signal using the clock synchronization signal, and outputting the modulated digital signal to a digital-to-analog converter so that the digital-to-analog converter outputs a first common voltage to a non-inverting input terminal of a first operational amplifier;

generating, by the first operational amplifier according to the first common voltage, the initial common voltage controlled by the ground voltage and the positive power supply voltage, wherein the ground voltage and the positive power supply voltage are supply voltages applied to the first operational amplifier by the power management integrated circuit after powered on.

According to an embodiment of the present disclosure, the method further includes:

adjusting an output accuracy of the common voltage, by adjusting a resistance of a first resistor coupled between an output terminal of the first operational amplifier and an inverting input terminal of the second operational amplifier and a resistance of a second resistor coupled between the inverting input terminal and an output terminal of the second operational amplifier.

The present disclosure provides a display device including the common voltage generation circuit according to an embodiment of the present disclosure and a display panel being driven by the common voltage generated by the common voltage generation circuit.

In an embodiment, the display panel is a display panel driven by an oxide semiconductor TFT.

DETAILED DESCRIPTION

The present disclosure will be further described in detail below in conjunction with the accompanying drawings and specific implementations in order that those skilled in the art can understand the technical solutions of the present disclosure better.

Figure 1:
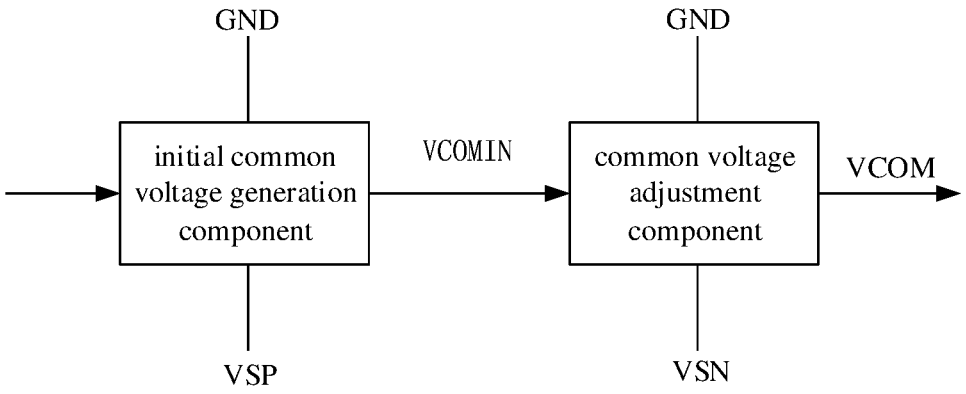
FIG. 1 is a block diagram of a common voltage generation circuit according to an embodiment of the present disclosure.

As shown in FIG. 1, an embodiment of the present disclosure provides a common voltage generation circuit which includes an initial common voltage generation component and a common voltage adjustment component. The initial common voltage generation component is configured to generate an initial common voltage (VCOMIN) controlled by a ground voltage GND and a positive power supply voltage VSP according to a clock synchronization signal and a serial digital signal as received; the common voltage adjustment component is configured to generate a common voltage VCOM controlled by the ground voltage GND and a negative power supply voltage VSN according to the initial common voltage.

It should be noted here that, the ground voltage GND, the positive power supply voltage VSP and the negative power supply voltage VSN are voltages generated by the power management integrated circuit (PMIC) after powered on.

In the common voltage generation circuit of the present embodiment, the initial common voltage generated by the initial common voltage generation component is controlled by the ground voltage GND and the positive power supply voltage VSP; since the ground voltage GND is a stable voltage of 0V, it must arrive at a steady state prior to the positive power supply voltage VSP; further, due to the characteristics of the operational amplifier itself, its output will follow a supply voltage that first arrives at the steady state. Therefore, the generated initial common voltage will arrive at the steady state with following the ground voltage GND. In this case, no spike will occur to the generated initial common voltage. Meanwhile, since the initial common voltage is controlled by the ground voltage GND and the positive power supply voltage VSP, the initial common voltage is a positive voltage. Similarly, the common voltage adjustment component generates the common voltage VCOM controlled by the ground voltage GND and the negative power supply voltage VSN according to the initial common voltage. Since the ground voltage GND is a stable voltage of 0V, it must arrive at a steady state prior to the negative power supply voltage VSN. Therefore, the generated common voltage VCOM will arrive at the steady state with following the ground voltage GND. In this case, no spike will occur to the generated common voltage VCOM. Meanwhile, since the common voltage VCOM is controlled by the ground voltage GND and the negative power supply voltage VSN, the common voltage VCOM is a negative voltage.

Figure 2:
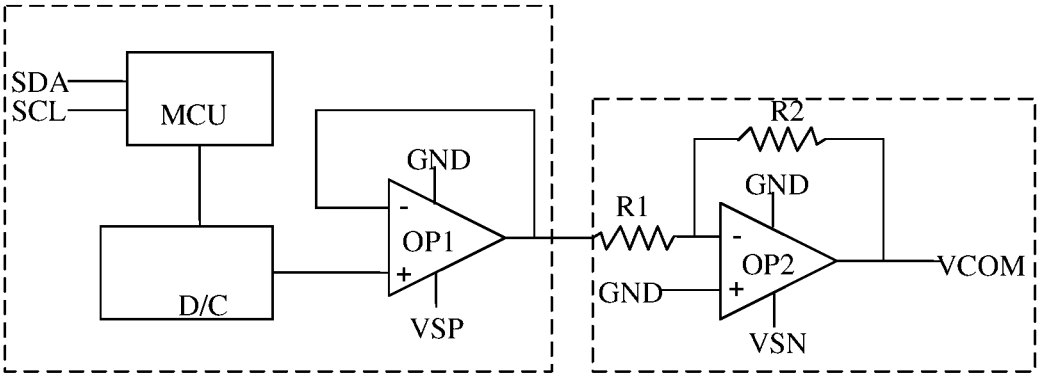
FIG. 2 is a schematic diagram of a common voltage generation circuit according to an embodiment of the present disclosure.

As shown in FIG. 2, the initial common voltage generation component includes a master controller MCU, a digital-to-analog converter D/C, and a first operational amplifier OP1.

The master controller MCU has an input terminal coupled to an I2C bus including a clock terminal SCL and a data terminal SDA, and an output terminal coupled to an input terminal of the digital-to-analog converter D/C. An output terminal of the digital-to-analog converter D/C is coupled to a non-inverting input terminal of the first operational amplifier OP1. An inverting input terminal of the first operational amplifier OP1 is coupled to an output terminal of the first operational amplifier OP1.

Specifically, the master controller MCU is configured to receive an external clock synchronization signal and an external serial digital signal, and output a modulated digital signal which is then transmitted to the digital-to-analog converter. The digital-to-analog converter then outputs an analogous first common voltage to the non-inverting input terminal of the first operational amplifier OP1; the first operational amplifier has its inverting input terminal coupled to its output terminal, and allows the first common voltage to be controlled by the ground voltage GND and the positive power supply voltage VSP applied to the first operational amplifier OP1 as supply voltages so as to generate the initial common voltage. Since the initial common voltage is controlled by the ground voltage GND and the positive power supply voltage VSP, it is a positive voltage.

The above master controller may be a microcontroller unit (MCU) in which a clock terminal SCL is used to transmit the clock synchronization signal and a data terminal SDA is used to transmit the serial digital signal, so that a synchronous data communication is achieved. The master controller receives, through the data terminal SDA and the clock terminal SCL, the clock synchronization signal and the serial digital signal provided by a host. The master controller modulates the serial digital signal using the clock synchronization signal, and outputs the modulated digital signal to the digital-to-analog converter D/C so that the digital-to-analog converter D/C outputs the analogous first common voltage. When the analogous first common voltage is inputted to the first operational amplifier OP1 which is applied with the ground voltage GND and the positive power supply voltage VSP as the supply voltages, the first operational amplifier OP1 outputs the initial common voltage controlled by the ground voltage GND and the positive power supply voltage VSP.

The common voltage adjustment component includes a second operational amplifier OP2.

Specifically, the second operational amplifier OP2 has a non-inverting input terminal provided with the ground voltage GND and an inverting input terminal coupled to an output terminal of the common voltage generation component, and is configured to generate, according to the initial common voltage, the common voltage VCOM controlled by the ground voltage GND and the negative power supply voltage VSN, and output the common voltage by an output terminal of the second operational amplifier.

The signal inputted to the inverting input terminal of the above second operational amplifier OP2 is the initial common voltage outputted by the initial common voltage generation component. The second operational amplifier OP2 inverts the initial common voltage and outputs the common voltage VCOM controlled by the ground voltage GND and the negative power supply voltage VSN. The common voltage VCOM is a common voltage having a negative value and is stable.

Furthermore, the common voltage adjustment component further includes a first resistor R1 and a second resister R2. The first resistor R1 is coupled between the output terminal of the initial common voltage generation component and the inverting input terminal of the second operational amplifier OP2; the second resistor R2 is coupled between the inverting input terminal and the output terminal of the second operational amplifier OP2. By adjusting the resistance ratio of the first resistor R1 and the second resistor R2, the accuracy of the generated common voltage VCOM can be adjusted.

Specifically, it is assumed that the resistance of the first resistor R1 is N times the resistance of the second resistor R2, and the adjustment accuracy of the common voltage (the common voltage (VCOM) generated by the second operational amplifier OP2) and the adjustment accuracy of the initial common voltage (VCOMIN) have the following relationship: $\Delta VCOM/R2=-\Delta VCOMIN/R1$;

That is: $\Delta VCOM=-(R2/R1)*\Delta VCOMIN=-1/N*\Delta VCOMIN$.

The adjustment accuracy of the initial common voltage (VCOMIN) may be understood as the adjustment accuracy of the common voltage in the absence of the common voltage adjustment component.

It can be seen from the above relationship that as long as the resistance of the second resistor R2 is selected to be smaller than the resistance of the first resistor R1, that is, $N>1$, the value of $\Delta VCOM$ is smaller than that of $\Delta VCOMIN$. That is, the adjustment accuracy of the common voltage outputted by the second operational amplifier OP2 can be improved.

Thus, in the present embodiment, the resistance of the second resistor R2 is smaller than that of the first resistor R1.

Hereinafter, a common voltage generation circuit is provided. As shown in FIG. 2, the common voltage generation circuit includes an initial common voltage generation component and a common voltage adjustment component. The initial common voltage generation component includes a master controller MCU, a digital-to-analog converter D/C, and a first operational amplifier OP1; the common voltage adjustment component includes a second operational amplifier OP2, a first resistor R1 and a second resistor R2.

The master controller MCU is configured to receive an external clock synchronization signal and an external serial digital signal, and the digital signal is converted into an analog signal by a digital-to-analog converter, thereby an analog first common voltage is outputted to the non-inverting input terminal of the first operational amplifier OP1; the inverting input terminal and the output terminal of the first operational amplifier OP1 are coupled to each other, and the ground voltage GND and the positive power supply voltage VSP are supplied to the first operational amplifier OP1 as the supply voltages of the first operational amplifier OP1. The first operational amplifier OP1 generates, according to the first common voltage, an initial common voltage controlled by the ground voltage GND and the positive power supply voltage VSP; the non-inverting input terminal of the second operational amplifier OP2 is coupled to the ground voltage GND, and the inverting input terminal of the second operational amplifier OP2 is coupled to the output terminal of the first operational amplifier OP1. The ground voltage GND and the negative power supply voltage VSN are supplied to the second operational amplifier OP2 as the supply voltages of the second operational amplifier OP2. The second operational amplifier OP2 generates, according to the initial common voltage, a common voltage VCOM controlled by the ground voltage GND and the negative power supply voltage VSN, and the common voltage VCOM is outputted by the output terminal of the second operational amplifier OP2; the first resistor R1 is coupled between the output terminal of the first operational amplifier OP1 and the inverting input terminal of the second operational amplifier OP2; and the second resistor R2 is coupled between the inverting input terminal and the output terminal of the second operational amplifier OP2.

The master controller may be a microcontroller unit. The input terminal of the master controller MCU is coupled to an I2C bus including a clock terminal SCL and a data terminal SDA, and the output terminal of the master controller MCU is coupled to the input terminal of the digital-to-analog converter D/C. The output terminal of the digital-to-analog converter D/C is coupled to the non-inverting input terminal of the first operational amplifier OP1. The inverting input terminal of the first operational amplifier OP1 is coupled to the output terminal of the first operational amplifier OP1.

Figure 3:
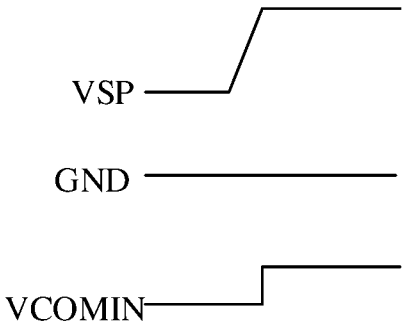
FIG. 3 is a waveform diagram of an initial common voltage outputted by a first operational amplifier of a common voltage generation circuit according to an embodiment of the present disclosure.
Figure 4:
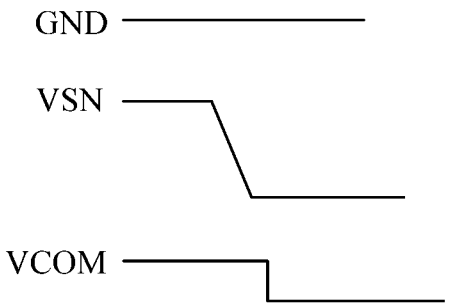
FIG. 4 is a waveform diagram of an initial common voltage outputted by a second operational amplifier of a common voltage generation circuit according to an embodiment of the present disclosure.

The clock terminal SCL is used to transmit the clock synchronization signal; and the data terminal SDA is used to transmit the serial digital signal, so that a synchronous data communication is achieved. The master controller receives the clock synchronization signal and the serial digital signal provided by the host. The master controller modulates the serial digital signal using the clock synchronization signal, and outputs the modulated digital signal to the digital-to-analog converter D/C so that the digital-to-analog converter D/C outputs the analogous first common voltage. When the analogous first common voltage is inputted to the first operational amplifier OP1 which is applied with the ground voltage GND and the positive power supply voltage VSP as the supply voltages, the first operational amplifier OP1 outputs the initial common voltage controlled by the ground voltage GND and the positive power supply voltage VSP, the waveform of which is shown in FIG. 3, and the initial common voltage is a positive voltage. Thereafter, the initial common voltage is inverted by the second operational amplifier OP2 which is applied with the ground voltage GND and the negative power supply voltage VSN as its supply voltages, and thereby the second operational amplifier OP2 outputs the common voltage VCOM controlled by the ground voltage GND and the negative power supply voltage VSN. The waveform of the common voltage VCOM is shown in FIG. 4. The common voltage VCOM is a common voltage VCOM having a negative value, and is stable. By adjusting the resistance ratio of the first resistor R1 and the second resistor R2, the adjustment accuracy of the common voltage outputted by the second operational amplifier OP2 is improved.

In summary, the common voltage generation circuit in the present embodiment eliminates effectively the problem of the occurrence of spikes to the common voltage caused by the power supply voltage during the power-on stage, and can output a common voltage VCOM having a negative value, which is beneficial to the display of an oxide display panel, and the accuracy of the common voltage VCOM is significantly improved. An oxide display panel generally indicates a display panel driven by an oxide semiconductor TFT, which requires higher stability of external drive signals due to the inherent sensitivity of the oxide semiconductor material. By using the common voltage that can be stabilized more quickly in the present disclosure as a reference voltage, some disadvantages that leads to the performance degradation of the oxide display panel can be eliminated.

Figure 5:
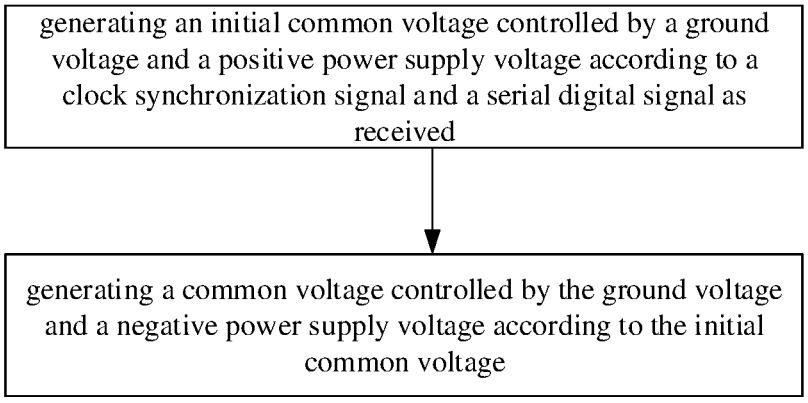
FIG. 5 is a flow chart of a common voltage generation method according to an embodiment of the present disclosure.

As shown in FIG. 5, the present embodiment provides a common voltage generation method. The common voltage may be generated by the common voltage generation circuit in the above embodiment. The method includes: generating an initial common voltage controlled by a ground voltage GND and a positive power supply voltage VSP according to a clock synchronization signal and a serial digital signal as received, wherein the initial common voltage is a positive voltage; and generating a common voltage VCOM controlled by the ground voltage GND and a negative power supply voltage VSN according to the initial common voltage, wherein the common voltage VCOM is a negative voltage.

Since the generated initial common voltage is controlled by the ground voltage GND and the positive power supply voltage VSP, and the ground voltage GND is a stable voltage of 0V, the ground voltage GND must arrive at a steady state prior to the positive power supply voltage VSP; further, due to the characteristics of the operational amplifier itself, its output will follow a power supply voltage that first arrives at the steady state. Therefore, the generated initial common voltage will arrive at the steady state with following the ground voltage GND. In this case, no spike will occur to the generated initial common voltage. Meanwhile, the common voltage VCOM is generated by the controlling of the ground voltage GND and the negative power supply voltage VSN according to the initial common voltage. Since the ground voltage GND is a stable voltage of 0V, it must arrive at the steady state when inputted into the common voltage adjustment component prior to the negative power supply voltage VSN. Therefore, the generated common voltage VCOM will arrive at the steady state with following the ground voltage GND. In this case, no spike will occur to the generated common voltage VCOM.

A common voltage generation method is provided below in conjunction with a common voltage generation circuit provided according to an embodiment of the present disclosure. Specifically, the method includes the following steps.

First step: receiving, by a master controller MCU, an external clock synchronization signal and a serial digital signal provided externally, and converting the digital signal outputted by the controller MCU into an analogous first common voltage through a digital-to-analog converter D/C; then, inputting the first common voltage to a first operational amplifier OP1 applied with a ground voltage GND and a positive power supply voltage VSP as supply voltages, so as to generate an initial common voltage controlled by the ground voltage GND and the positive power supply voltage VSP.

Specifically, the master controller may be a microcontroller unit (MCU). The master controller MCU has its input terminal coupled to an I2C bus including a clock terminal SCL and a data terminal SDA, and its output terminal coupled to an input terminal of the digital-to-analog converter D/C. An output terminal of the digital-to-analog converter D/C is coupled to a non-inverting input terminal of the first operational amplifier OP1. An inverting input terminal of the first operational amplifier OP1 is coupled to the output terminal of the first operational amplifier OP1. The clock terminal SCL is used to transmit the clock synchronization signal; and the data terminal SDA is used to transmit the serial digital signal, so that a synchronous data communication is achieved. The master controller receives the clock synchronization signal and the serial digital signal provided by a host. The master controller modulates the serial digital signal using the clock synchronization signal, and outputs the modulated digital signal to the digital-to-analog converter D/C so that the digital-to-analog converter D/C outputs the analogous first common voltage. The first common voltage is inputted to the first operational amplifier OP1 applied with the ground voltage GND and the positive power supply voltage VSP as the supply voltages, so that the first operational amplifier OP1 outputs an initial common voltage controlled by the ground voltage GND and the positive power supply voltage VSP.

Second step: inputting the initial common voltage to an inverting input terminal of a second operational amplifier OP2, inverting the initial common voltage by the second operational amplifier OP2 and outputting a common voltage VCOM under the control of the ground voltage GND and the negative power supply voltage VSN, wherein the common voltage VCOM is a negative common voltage and is stable.

Third step, adjusting an output accuracy of the common voltage VCOM outputted by the second operational amplifier OP2, by adjusting a resistance of a first resistor R1 coupled between the output terminal of the first operational amplifier OP1 and the inverting input terminal of the second operational amplifier OP2 and a resistance of a second resistor R2 coupled between the inverting input terminal and the output terminal of the second operational amplifier OP2.

Specifically, it is assumed that the resistance of the first resistor R1 is N times the resistance of the second resistor R2, and the adjustment accuracy of the common voltage VCOM (the common voltage generated by the second operational amplifier OP2) and the adjustment accuracy of the initial common voltage (VCOMIN) have the following relationship: $\Delta VCOM/R2=-\Delta VCOMIN/R1$;

That is: $\Delta VCOM=-(R2/R1)*\Delta VCOMIN=-1/N*\Delta VCOMIN$.

It can be seen from the above relationship that, as long as the resistance of the second resistor R2 is selected to be smaller than the resistance of the first resistor R1, that is, $N>1$, the value of $\Delta VCOM$ is smaller than that of $\Delta VCOMIN$. That is, the adjustment accuracy of the common voltage outputted by the second operational amplifier OP2 can be improved.

In summary, the common voltage generation method in the present embodiment eliminates effectively the problem of the occurrence of spikes to the common voltage VCOM caused by the power supply voltage during the power-on stage, and can output a negative common voltage, which is beneficial to the display of an oxide display panel, and the accuracy of the common voltage VCOM is significantly improved.

The present embodiment provides a display device which includes the common voltage generation circuit in the above embodiment and a display panel driven by the common voltage generated by the common voltage generation circuit. Therefore, the display device of the present embodiment has a better display effect.

The display device may be a liquid crystal display device or an electroluminescence display device, for example, any product or component having a display function such as a liquid crystal panel, an electronic paper, an OLED panel, a mobile phone, a tablet, a television, a display, a notebook computer, a digital photo frame, a navigator, and so on.

It will be appreciated that the above embodiments are merely exemplary implementations employed to explain the principles of the present disclosure, but the present disclosure is not limited thereto. Various modifications and improvements can be made by those skilled in the art without departing from the spirit and scope of the disclosure, and such modifications and improvements are also considered to be within the scope of the present disclosure.

What is claimed is:

1. A common voltage generation circuit comprising:

an initial common voltage generation component configured to generate an initial common voltage controlled by a ground voltage and a positive power supply voltage according to a clock synchronization signal and a serial digital signal as received; and a common voltage adjustment component configured to generate a common voltage controlled by the ground voltage and a negative power supply voltage according to the initial common voltage, wherein the common voltage adjustment component comprises a second operational amplifier, wherein the second operational amplifier has a non-inverting input terminal provided with the ground voltage and an inverting input terminal coupled to an output terminal of the initial common voltage generation component, and is configured to generate the common voltage controlled by the ground voltage and the negative power supply voltage according to the initial common voltage and to output the common voltage by an output terminal of the second operational amplifier, and wherein the ground voltage and the negative power supply voltage are supply voltages applied to the second operational amplifier by a power management integrated circuit after powered on.

2. The common voltage generation circuit of claim 1, wherein the common voltage adjustment component further comprises a first resistor and a second resistor, and wherein the first resistor is coupled between the output terminal of the initial common voltage generation component and the inverting input terminal of the second operational amplifier; and the second resistor is coupled between the inverting input terminal and the output terminal of the second operational amplifier.

3. The common voltage generation circuit of claim 2, wherein a resistance of the second resistor is smaller than that of the first resistor.

4. The common voltage generation circuit of claim 3, wherein the initial common voltage generation component comprises a master controller, a digital-to-analog converter, and a first operational amplifier, wherein, the master controller has an input terminal coupled to an I2C bus comprising a clock terminal and a data terminal and an output terminal coupled to an input terminal of the digital-to-analog converter; an output terminal of the digital-to-analog converter is coupled to a non-inverting input terminal of the first operational amplifier, and an inverting input terminal of the first operational amplifier is coupled to an output terminal of the first operational amplifier, the master controller is configured to receive the clock synchronization signal and the serial digital signal provided by a host through the clock terminal and the data terminal, modulate the serial digital signal using the clock synchronization signal, and output the modulated digital signal to the digital-to-analog converter so that the digital-to-analog converter outputs a first common voltage to the non-inverting input terminal of the first operational amplifier the first operational amplifier generates the initial common voltage controlled by the ground voltage and the positive power supply voltage according to the first common voltage, wherein the ground voltage and the positive power supply voltage are supply voltages applied to the first operational amplifier by the power management integrated circuit after powered on.

5. A display device, comprising the common voltage generation circuit of claim 3 and a display panel being driven by the common voltage generated by the common voltage generation circuit.

6. The common voltage generation circuit of claim 2, wherein the initial common voltage generation component comprises a master controller, a digital-to-analog converter, and a first operational amplifier, wherein, the master controller has an input terminal coupled to an I2C bus comprising a clock terminal and a data terminal and an output terminal coupled to an input terminal of the digital-to-analog converter; an output terminal of the digital-to-analog converter is coupled to a non-inverting input terminal of the first operational amplifier, and an inverting input terminal of the first operational amplifier is coupled to an output terminal of the first operational amplifier, the master controller is configured to receive the clock synchronization signal and the serial digital signal provided by a host through the clock terminal and the data terminal, modulate the serial digital signal using the clock synchronization signal, and output the modulated digital signal to the digital-to-analog converter so that the digital-to-analog converter outputs a first common voltage to the non-inverting input terminal of the first operational amplifier; the first operational amplifier generates the initial common voltage controlled by the ground voltage and the positive power supply voltage according to the first common voltage, wherein the ground voltage and the positive power supply voltage are supply voltages applied to the first operational amplifier by the power management integrated circuit after powered on.

7. A display device, comprising the common voltage generation circuit of claim 2 and a display panel being driven by the common voltage generated by the common voltage generation circuit.

8. The common voltage generation circuit of claim 1, wherein the initial common voltage generation component comprises a master controller, a digital-to-analog converter, and a first operational amplifier, wherein, the master controller has an input terminal coupled to an I2C bus comprising a clock terminal and a data terminal and an output terminal coupled to an input terminal of the digital-to-analog converter; an output terminal of the digital-to-analog converter is coupled to a non-inverting input terminal of the first operational amplifier, and an inverting input terminal of the first operational amplifier is coupled to an output terminal of the first operational amplifier, the master controller is configured to receive the clock synchronization signal and the serial digital signal provided by a host through the clock terminal and the data terminal, modulate the serial digital signal using the clock synchronization signal, and output the modulated digital signal to the digital-to-analog converter so that the digital-to-analog converter outputs a first common voltage to the non-inverting input terminal of the first operational amplifier; the first operational amplifier generates the initial common voltage controlled by the ground voltage and the positive power supply voltage according to the first common voltage, wherein the ground voltage and the positive power supply voltage are supply voltages applied to the first operational amplifier by the power management integrated circuit after powered on.

9. A display device, comprising the common voltage generation circuit of claim 8 and a display panel being driven by the common voltage generated by the common voltage generation circuit.

10. The common voltage generation circuit of claim 1, wherein the initial common voltage generation component comprises a master controller, a digital-to-analog converter, and a first operational amplifier, wherein, the master controller has an input terminal coupled to an I2C bus comprising a clock terminal and a data terminal and an output terminal coupled to an input terminal of the digital-to-analog converter; an output terminal of the digital-to-analog converter is coupled to a non-inverting input terminal of the first operational amplifier, and an inverting input terminal of the first operational amplifier is coupled to an output terminal of the first operational amplifier, the master controller is configured to receive the clock synchronization signal and the serial digital signal provided by a host through the clock terminal and the data terminal, modulate the serial digital signal using the clock synchronization signal, and output the modulated digital signal to the digital-to-analog converter so that the digital-to-analog converter outputs a first common voltage to the non-inverting input terminal of the first operational amplifier; the first operational amplifier generates the initial common voltage controlled by the ground voltage and the positive power supply voltage according to the first common voltage, wherein the ground voltage and the positive power supply voltage are supply voltages applied to the first operational amplifier by the power management integrated circuit after powered on.

11. A display device, comprising the common voltage generation circuit of claim 1 and a display panel being driven by the common voltage generated by the common voltage generation circuit.

12. The display device of claim 11, wherein the display panel is a display panel driven by an oxide semiconductor TFT.

13. A common voltage generation method comprising:

generating an initial common voltage controlled by a ground voltage and a positive power supply voltage according to a clock synchronization signal and a serial digital signal as received; and generating a common voltage controlled by the ground voltage and a negative power supply voltage according to the initial common voltage, wherein the step of generating the common voltage controlled by the ground voltage and the negative power supply voltage according to the initial common voltage comprises:

generating, by a second operational amplifier according to the initial common voltage, the common voltage controlled by the round voltage and the negative power supply voltage, and outputting the common voltage by an output terminal of the second operational amplifier, wherein the ground voltage and the negative power supply voltage are supply voltages applied to the second operational amplifier by a power management integrated circuit after powered on.

14. The common voltage generation method of claim 13, wherein the step of generating the initial common voltage controlled by the ground voltage and the positive power supply voltage according to the clock synchronization signal and the serial digital signal as received comprises:

receiving, by a master controller, the clock synchronization signal and the serial digital signal provided by a host, modulating the serial digital signal using the clock synchronization signal, and outputting the modulated digital signal to a digital-to-analog converter so that the digital-to-analog converter outputs a first common voltage to a non-inverting input terminal of a first operational amplifier;

generating, by the first operational amplifier according to the first common voltage, the initial common voltage controlled by the ground voltage and the positive power supply voltage, wherein the ground voltage and the positive power supply voltage are supply voltages applied to the first operational amplifier by the power management integrated circuit after powered on.

15. The common voltage generation method of claim 14, further comprising:

adjusting an output accuracy of the common voltage, by adjusting a resistance of a first resistor coupled between an output terminal of the first operational amplifier and an inverting input terminal of the second operational amplifier and a resistance of a second resistor coupled between the inverting input terminal and an output terminal of the second operational amplifier.

* * * * *